US007167658B2

(12) United States Patent
Ooki et al.

(10) Patent No.: US 7,167,658 B2
(45) Date of Patent: Jan. 23, 2007

(54) IMAGE FORMING APPARATUS WHICH CORRECTS AN OUTPUT OF A SENSOR FOR DETECTING IMAGE GRADATION CHARACTERISTICS

(75) Inventors: Makoto Ooki, Tokyo (JP); Kousuke Touura, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 257 days.

(21) Appl. No.: 10/846,763

(22) Filed: May 13, 2004

(65) Prior Publication Data

US 2005/0025509 A1 Feb. 3, 2005

(30) Foreign Application Priority Data

Jul. 28, 2003 (JP) ..... 2003-202428

(51) Int. Cl.
*G03G 15/00* (2006.01)

(52) U.S. Cl. ..... 399/49; 399/74

(58) Field of Classification Search ..... 399/15, 399/49, 72, 74
See application file for complete search history.

(56) References Cited

U.S. PATENT DOCUMENTS 5,805,314 A * 9/1998 Abe et al. ..... 358/518
5,991,558 A * 11/1999 Emi et al. ..... 399/49
6,115,561 A * 9/2000 Fukushima ..... 399/49
6,148,158 A * 11/2000 Amemiya ..... 399/39
6,185,386 B1 * 2/2001 Noguchi ..... 399/49
6,898,381 B1 * 5/2005 Maebashi et al. ..... 399/15

FOREIGN PATENT DOCUMENTS

JP 04268873 A * 9/1992
JP 06-197873 A 7/1994
JP 08328322 A * 12/1996
JP 2000081739 A * 3/2000
JP 2001-251510 9/2001

* cited by examiner

*Primary Examiner*—Robert Beatty
(74) *Attorney, Agent, or Firm*—Frishauf, Holtz, Goodman & Chick, P.C.

(57) ABSTRACT

An image forming apparatus, comprising: an image forming section for forming and outputting a predetermined gradation patch pattern image on transfer paper; a sensor for reading and outputting the gradation patch pattern image; and a control section for correcting reading characteristics of the sensor on the basis of an output value of the sensor obtained by reading the gradation patch pattern image and a color value of the gradation patch pattern image formed on the transfer paper.

6 Claims, 5 Drawing Sheets

IMAGE FORMING APPARATUS WHICH CORRECTS AN OUTPUT OF A SENSOR FOR DETECTING IMAGE GRADATION CHARACTERISTICS

BACKGROUND OF THE INVENTION.

1. Technical Field of the Invention

The present invention relates to an image forming apparatus having a function of correcting gradation characteristics of an image forming section on the basis of an internal sensor.

2. Description of the Related Arts

Conventionally, there has been known an image forming apparatus such as a color copying machine or a color printer, having a sensor inside its machinery in order to output an image having a good gradation, with a function of reading patch patterns having a plurality of gradation tones formed inside the image forming section by using the sensor, generating a correction table so as to achieve a desired value from the obtained value, and correcting the gradation tones by using the correction table (for example, refer to Japanese Unexamined Patent Publication (Kokai) No. 2001-251510 and Japanese Unexamined Patent Publication No. Hei 6-197873).

In the above, the sensor practically outputs a reflectance or the like as an output value. Then, the image forming apparatus converts the sensor output value to, for example, an XYZ value by using a certain conversion curve to use it as a sensor read value for a gradation correction. The conversion curve has been obtained by forming and outputting the same image as the above patch patterns on transfer paper and calculating a conversion coefficient with carrying out a regression calculation using a result of color measuring with a calorimeter and a reflectance of the sensor. The coefficient is a fixed value.

The sensor reading characteristics, however, may change with time due to a change in sensor characteristics such as a consumption or a change of toner or any other material, a dirt on the sensor, a displacement or an inclination of the sensor, or the like, thereby causing the conversion coefficient to be unsuitable and resulting in an unstable output result even after the gradation correction has been made using the sensor.

SUMMARY OF THE INVENTION

To resolve the above problem, the present invention has been provided. Therefore, it is an object of the present invention to provide an image forming apparatus capable of improving accuracy of measurement of a sensor so as to achieve an output image having more stable gradation characteristics by correcting a coefficient necessary for a conversion of a sensor output value.

According to a first aspect of the present invention to achieve the above object, there is provided an image forming apparatus, comprising: an image forming section for forming and outputting a predetermined gradation patch pattern image on transfer paper and forming it inside itself; a sensor for reading and outputting the gradation patch pattern image formed inside the image forming section; and a control section for correcting reading characteristics of the sensor on the basis of an output value of the sensor obtained by reading the gradation patch pattern image and a color value of the gradation patch pattern image formed on the transfer paper.

According to the above feature, the sensor reading characteristics are corrected on the basis of the sensor output value obtained by reading the gradation patch pattern image and the color value of the gradation patch pattern image formed on the transfer paper. Therefore, it is possible to correct the sensor reading characteristics easily so as to adapt them to changes in sensor characteristics or in a printing environment, thereby improving the accuracy of measurement with the sensor. This enables an appropriate correction of gradation characteristics of the image forming section with the sensor, thereby achieving an output image having a stable gradation.

According to a second aspect of the present invention, there is provided an image forming apparatus as set forth in the first aspect, wherein the control section calculates a sensor correction coefficient by carrying out a regression calculation with the color value of the gradation patch pattern image formed on the transfer paper and the sensor output value obtained by reading the gradation patch pattern image and converts the sensor output value to a color value using the sensor correction coefficient to correct the sensor reading characteristics.

According to the above feature, the sensor reading characteristics are corrected by calculating the sensor correction coefficient by carrying out the regression calculation with the color value of the gradation patch pattern image formed on the transfer paper and the sensor output value obtained by reading the gradation patch pattern image and by converting the sensor output value to the color value using the sensor correction coefficient. Therefore, it is possible to correct the sensor reading characteristics easily so as to adapt them to changes in sensor characteristics or in a printing environment, thereby improving the accuracy of measurement with the sensor. This enables an appropriate correction of gradation characteristics of the image forming section with the sensor, thereby achieving an output image having a stable gradation.

According to a third aspect of the present invention, there is provided an image forming apparatus as set forth in the first or second aspect, further comprising a scanner section for reading an image on a document, wherein color measuring is performed on the gradation patch pattern image formed on the transfer paper by the scanner section.

According to the above feature, the image forming apparatus has the scanner section and measures colors of the gradation patch pattern image formed on the transfer paper by the scanner section. Therefore, it is possible to achieve the color value of the gradation patch pattern image easily.

According to a fourth aspect of the present invention, there is provided an image forming apparatus as set forth in the second or third aspect, further comprising an operation section for inputting an instruction to return the sensor correction coefficient to an initial value or to a value immediately before the correction, wherein the control section returns the sensor correction coefficient to the initial value or to the value immediately before the correction on the basis of the instruction input from the operation section.

According to the above feature, the image forming apparatus is provided with the operation section for inputting the instruction to return the sensor correction coefficient to the initial value or to the value immediately before the correction, thereby enabling the sensor correction coefficient to be returned to the initial value or to the value immediately before the correction on the basis of the instruction input from the operation section. Therefore, even in the case of some problem in the sensor correction, it is possible to return the value easily to the sensor correction coefficient before the correction, thus providing a user-friendly sensor correcting function.

According to a fifth aspect of the present invention, there is provided an image forming apparatus as set forth in one of the first to fourth aspects, wherein the gradation patch pattern image is made up of a plurality of patch patterns each having a plurality of gradation tones arranged in such a way as to be displaced by an interval of a 1/n cycle length (n is an integer) of a photosensitive drum in the image forming section.

According to the above feature, the gradation patch pattern image is made up of the plurality of patch patterns each having the plurality of gradation tones arranged in such a way as to be displaced by the interval of the 1/n cycle length (n is an integer) of the photosensitive drum in the image forming section. Therefore, the color value and the sensor value are obtained by averaging results of the color measuring of the patches having the same color and the same gradation tone and results of the sensor output, thereby reducing an effect of unevenness in the cycle of the photosensitive drum.

According to a sixth aspect of the present invention, there is provided an image forming apparatus as set forth in one of the first to fifth aspects, wherein a mark indicating an upper end of the transfer paper is added to the gradation patch pattern image formed on the transfer paper by using a color not used in the gradation patch patterns.

According to the above feature, the mark indicating the upper end of the transfer paper is added to the gradation patch pattern image formed on the transfer paper by using the color not used in the gradation patch patterns. Therefore, when measuring colors of the gradation patch pattern image with the scanner section or the like, a user does not get a wrong arrangement direction of the image and therefore can carry out correct color measuring.

According to a seventh aspect of the present invention, there is provided an image forming apparatus as set forth in the sixth aspect, wherein the gradation patch pattern image is made up of patch patterns each having a plurality of gradation tones for each of yellow, magenta, cyan, and black colors and wherein the mark added to the gradation patch pattern image has a color of an approx. 100 to 240 deg hue angle.

According to the above feature, the mark having the color of the approx. 100 to 240 deg hue angle is added to the gradation patch pattern image made up of patch patterns of the yellow, magenta, cyan, and black colors. Therefore, the mark can be identified without confusion with the colors in the gradation patch patterns.

The above and many other objects, features and advantages of the present invention will become manifest to those skilled in the art upon making reference to the following detailed description and accompanying drawings in which a preferable embodiment incorporating the principle of the present invention are shown by way of illustrative examples.

DETAILED DESCRIPTION OF THE PREFERRED EMBODIMENTS

A preferred embodiment of the present invention will now be described in detail hereinafter with reference to the accompanying drawings.

A configuration of the embodiment of the present invention is described, first.

Figure 1:
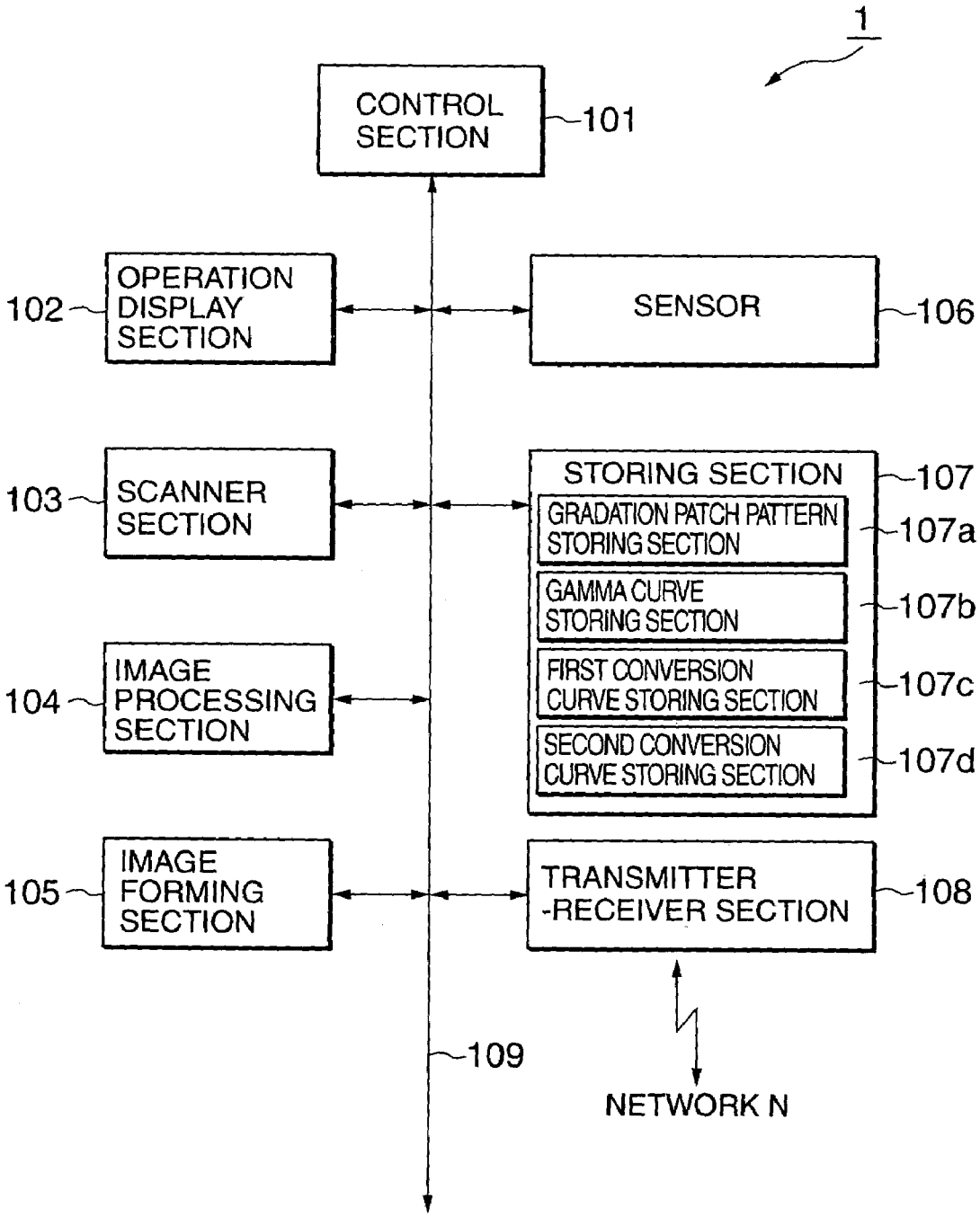
FIG. 1 is a block diagram showing a functional configuration of an image forming apparatus 1 according to the present invention.

Referring to FIG. 1, there is shown an example of outline internal configuration of an image forming apparatus 1 according to the present invention. The image forming apparatus 1 is, for example, an electrophotographic color copying machine, which comprises a control section 101, an operation display section 102, a scanner section 103, an image processing section 104, an image forming section 105, a sensor 106, a storing section 107, and a transmitter-receiver section 108, connected to each other via a bus 109 as shown in FIG. 1.

The control section 101 comprises a central processing section (CPU), a read only memory (ROM), and a random access memory (RAM). The CPU in the control section 101 reads out a system program and various processing programs stored in the ROM and expands them to the RAM with an operation of the operation display section 102 and integrally controls operations of the sections in the image forming apparatus 1 according to the expanded programs. Additionally, the control section 101 executes various processes including a sensor correction coefficient calculation process (see FIG. 3) described later according to the expanded programs.

Furthermore, according to the expanded programs, control section 101 forms a gradation patch pattern image stored in a gradation patch pattern storing section 107*a* on an intermediate transfer belt 56 in the image forming section 105 at activating the image forming apparatus 1 or at a certain timing such as at a fixed printing interval, converts a reflectance obtained by reading the patches with the sensor 106 to XYZ data by using a conversion curve stored in a second conversion curve storing section 107*d*, and executes a gamma curve data correction process for changing gamma curve data for use in gamma correction process in the image processing section 104 on the basis of the result obtained.

The operation display section 102 comprises a liquid crystal display (LCD), which displays statuses of various operation buttons or the apparatus or operation statuses of functions on a display screen according to an instruction of a display signal input from the control section 101. The LCD display screen is covered with a pressure-sensitive (resistive-film pressure-sensitive) touch panel including transparent electrodes arranged in grid form. The operation display section 102 detects XY coordinates of a power point pressed with fingers or a touch pen by means of a voltage value and outputs a detected position signal as an operation signal to the control section 101. The operation display section 102 has various operation buttons such as numeric buttons and a start button and outputs an operation signal generated by a button operation to the control section 101.

The scanner section 103 has a scanner under a contact glass on which a document is placed and reads an image on the document. The scanner comprises a light source, a charge coupled device (CCD), and an A/D converter. It reads the image on the document as RGB signals by focusing and photoelectrically transferring a reflected light of the light emitted in light scanning from the light source to the document, A/D-converts the read image, and outputs it to the image processing section 104. It should be noted here that the image is not limited to image data such as a graphic or a photograph, but includes text data such as characters or symbols.

The image processing section 104 converts RGB data obtained by reading it with the scanner section 103 and the RGB data transmitted from the transmitter-receiver section 108 to XYZ data by using a conversion curve stored in a first conversion curve storing section 107*c*, performs a color conversion process of converting the XYZ data to YMCK data, performs a gamma correction process of correcting gradation characteristics of the image forming section 105 by using gamma curve data of colors stored in a gamma curve storing section 107*b* and an image process such as a halftone process for the respective color data of the YMCK data, and outputs the data to the image forming section 105. The image processing section 104 reads out the YMCK data for forming a gradation patch pattern image (described later in detail) stored in the gradation patch pattern storing section 107*a* on the basis of an instruction from the control section 101 and outputs it to the image forming section 105.

The image forming section 105 forms and outputs an image on transfer paper on the basis of the YMCK image data output from the image processing section 104 in the electrophotographic method.

Figure 2:
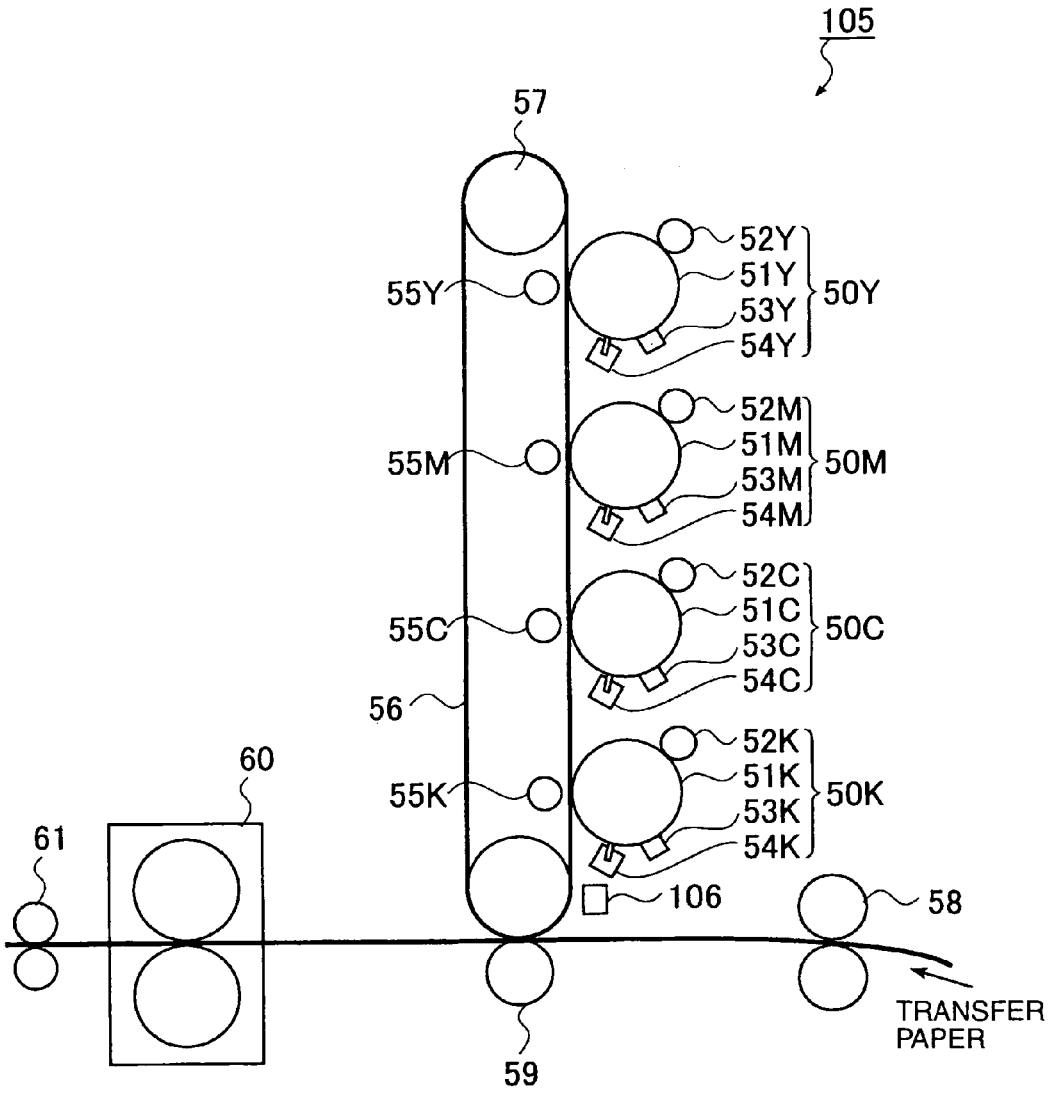
FIG. 2 is an explanatory diagram showing an outline internal configuration of an image forming section 105 shown in FIG. 1.

Referring to FIG. 2, there is shown a configuration of a relevant part of the image forming section 105. As shown in FIG. 2, the image forming section 105 comprises photosensitive sections 50Y, 50M, 50C, and 50K forming a toner image with Y, M, C, and K colors, an intermediate transfer belt 56 as an intermediate transfer member for carrying the toner image formed by the photosensitive sections 50Y, 50M, 50C, and 50K to transfer paper with a free rotation of a roller 57, a registration roller 58 for conveying the transfer paper, a secondary transfer roller 59 for transferring the toner image formed on the intermediate transfer belt 56 to the transfer paper, a fixing section 60 for fixing the toner image to the transfer paper, and a discharging roller 61 for discharging the transfer paper.

The photosensitive section 50Y comprises a photosensitive drum 51Y, a developing device 52Y, a charger 53Y, a cleaner 54Y, and a primary transfer roller 55Y. The same is true in the photosensitive sections 50M, 50C, and 50K.

The following describes an image formation in the image forming section 105. First in the photosensitive section 50Y, the photosensitive drum 51Y rotates and its surface is charged by the charger 53Y. With an exposure with exposure means such as a laser beam source not shown, a latent image of an image based on Y data input from the image processing section 104 is formed in the charged area. Then, the developing device 52Y forms a yellow toner image in the latent image area. The toner image is transferred to the intermediate transfer belt 56 by pressure welding of the primary transfer roller 55Y. The toner image becomes a yellow image corresponding to the image data to be output. Toner that has not been transferred is removed using the cleaner 54Y.

The same is true in the photosensitive sections 50M, 50C, and 50K, by which a magenta toner image, a cyan toner image, and a black toner image are formed and transferred similarly. The intermediate transfer belt 56 rotationally moves with the rotations of the roller 57, the primary transfer rollers 55Y, 55M, 55C, 55K, and the secondary transfer roller 59, by which the Y, M, C, and K toner images are superposed on each other in order and transferred to the intermediate transfer belt 56. In addition, transfer paper is conveyed from a paper feed tray not shown to the secondary transfer roller 59 with the rotation of the registration roller 58.

The transfer paper passes through a pressure welding portion of the secondary transfer roller 59, thereby causing the Y, M, C, and K toner images on the intermediate transfer belt 56 to be transferred to the transfer paper. The transfer paper to which the Y, M, C, and K toner images have been transferred passes through the fixing section 60. The Y, M, C, and K toner images are fixed to the transfer paper with the pressure and heat applied by the fixing section 60, by which a color image is formed. The transfer paper having the formed image is conveyed to a discharge tray not shown by means of the discharging roller 61. For double-sided printing, a double-sided conveying section not shown turns over the transfer paper having the formed image on one side and the registration roller 58 conveys it to the secondary transfer roller 59 so that an image is formed on the other side having no image.

The sensor 106 shown in FIG. 1 applies light to patches of the gradation patch pattern image formed on the intermediate transfer belt 56 in the image forming section 105, receives its reflected light, and outputs a reflectance as an output value of the sensor (hereinafter, referred to as a sensor value) to the control section 101.

The storing section 107 comprises a flash memory, having a gradation patch pattern storing section 107*a* for storing YMCK data for use in forming a gradation patch pattern image, a gamma curve data storing section 107*b* for storing gamma curve data for use in correcting gradation characteristics of the image forming section 105 for each of the Y, M, C, and K colors, a first conversion curve storing section 107*c* for storing a conversion curve for use in converting RGB data obtained by the scanner section 103 to XYZ data, and a second conversion curve storing section 107*d* for storing a conversion curve for use in converting a sensor value output from the sensor 106 to XYZ data.

Preferably, the conversion curve for use in converting RGB data to XYZ data is generated by using a value averaged among a plurality of paper types.

The transmitter-receiver section 108 comprises a modem, a LAN adapter, a router, and a terminal adapter (TA) and controls communications with devices connected to a network N via communication lines such as an exclusive line or an ISDN line.

An operation will be described below.

Figure 3:
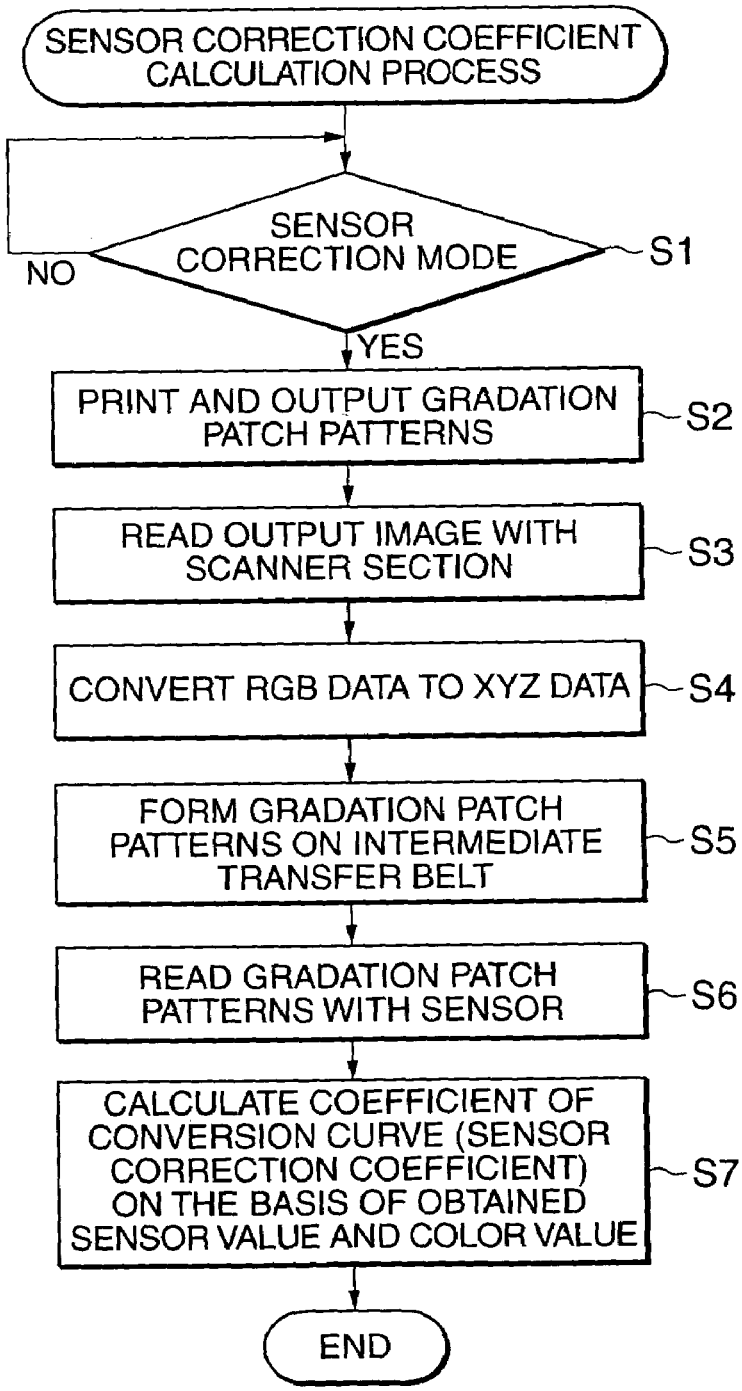
FIG. 3 is a flowchart showing a sensor correction coefficient calculation process executed by a control section 101 shown in FIG. 1.

Referring to FIG. 3, there is shown a flowchart of the sensor correction coefficient calculation process executed by the control section 101. The sensor correction coefficient calculation process will be described hereinafter by referring to FIG. 3.

The operation display section 102 of the image forming apparatus 1 gives an instruction to switch to a sensor correction mode (Step S1; YES). Thereupon, the YMCK data stored in the gradation patch pattern storing section 107*a* is read out, and the image forming section 105 prints and outputs the gradation patch pattern image onto the transfer paper (Step S2). Subsequently, the scanner section 103 reads the output image output in Step S2 (Step S3) and the obtained RGB data is converted to XYZ data using the conversion curve stored in the first conversion curve storing section 107*c* (Step S4). With this process, a color value of each patch is obtained on the gradation patch pattern image formed on the transfer paper. While it is assumed that the gradation patch pattern image is previously stored, it is possible to generate the image through software processing each time. Furthermore, while XYZ data is used as a color value here, it is not limited to that, but it is also possible to use, for example, L*a*b* data.

Subsequently, the same image as the above gradation patch pattern image is formed on the intermediate transfer belt 56 of the image forming section 105 (Step S5) and the sensor 106 reads the patches (Step S6). Thereafter, a regression calculation is performed with the sensor value obtained by reading each patch and the color value obtained by measuring a color of each patch of the output image of the gradation patch pattern image to find a sensor correction coefficient. Then, a conversion curve obtained by using the correction coefficient is stored in the second conversion curve storing section 107*d* (Step S7).

In this manner, the correction coefficient for converting the sensor value to the color value is obtained on the basis of the sensor value obtained by reading the gradation patch pattern image with the sensor 106 and the color value obtained by reading the same gradation patch pattern image with the scanner section 103. Therefore, it is possible to correct both changes in reading characteristics of the sensor 106 caused by changes inherent in the sensor such as a dirt or a displacement of the sensor 106 and changes in reading characteristics of the sensor 106 caused by changes in printing environment such as a consumption or a change of toner or any other material.

Figure 4:
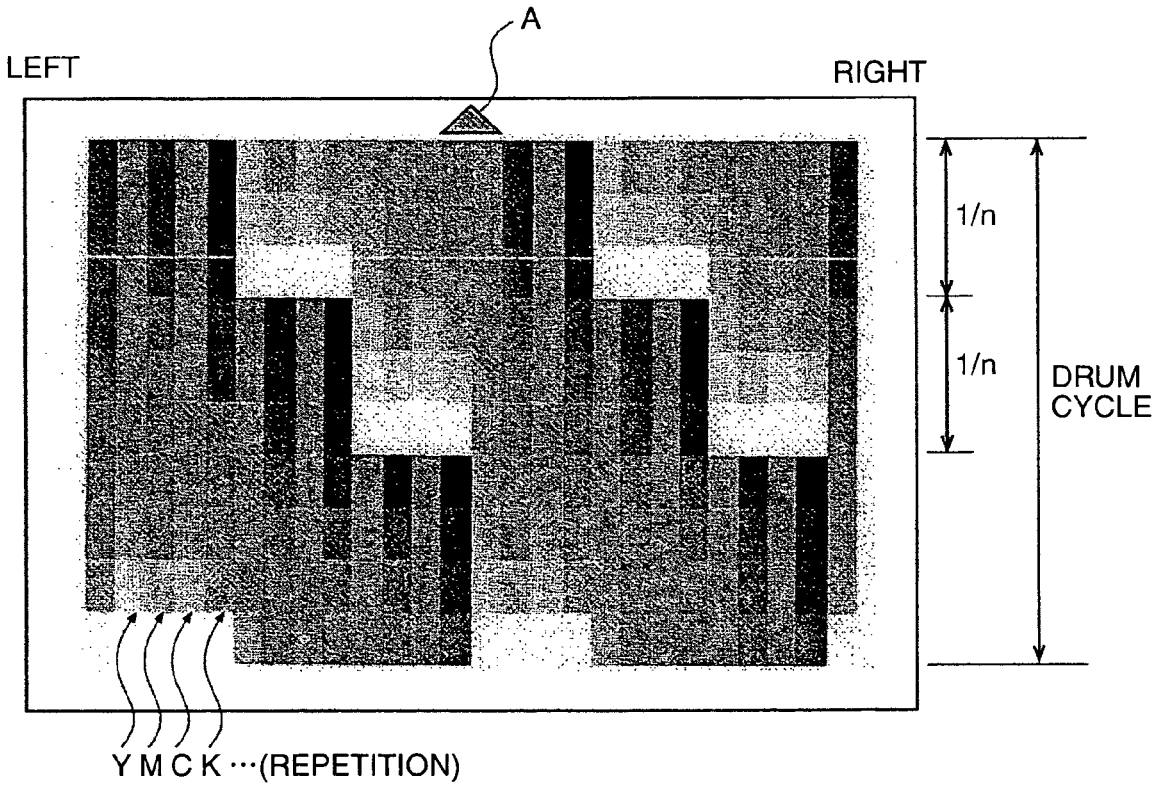
FIG. 4 is an explanatory diagram showing an example of a gradation patch pattern image.

Referring to FIG. 4, there is shown an example of the gradation patch pattern image output from the image forming section 105 in Step S2. As shown in FIG. 4, in the gradation patch pattern, a single pattern is considered to be a plurality of patches (10 patches in this embodiment) having substantially the same size and differences in tone of a single color of Y, M, C, or K, arranged in the order of gradation tones. The patches located in the columns at both ends in the horizontal direction are not used for measurement. In the gradation patch pattern, a plurality of the patterns (three patterns in this embodiment) arranged with higher tone patches displaced by an interval of a 1/n (⅓ in this embodiment) cycle length of the photosensitive drum with consideration given to unevenness of the photosensitive drum cycle, and two sets of the plurality of patterns (three patterns in this embodiment) are arranged on either side with consideration given to unevenness of the horizontal scanning direction. In other words, color measuring can be performed in sections of six patches indicating the same tone of the same color and their average value is calculated to obtain a color value for use in calculating a correction coefficient.

The same is true in the gradation patch pattern image formed in Step S5. The sensor 106 reads a plurality of patches indicating the same tone of the same color and outputs sensor values, and their average value is calculated and considered to be a sensor value for use in calculating the correction coefficient.

By generating a plurality of patterns, each of which is made up of the plurality of patches having the same size and differences in tone of a single color of Y, M, C, or K arranged in the order of gradation tones, being displaced by an interval of a 1/n (n is an integer) cycle length of the photosensitive drum in this manner, it becomes possible to obtain the color value and the sensor value free from unevenness of the cycle of the photosensitive drum.

When colors of the gradation patch pattern image are measured with the scanner section 103, an output image need be correctly placed on the contact glass. Therefore, a mark A indicating an upper end of the transfer paper is added to the output image. A mark color is preferably a color identifiable without confusion with the gradation patch pattern at a glance, in other words, a color not confused with the Y, M, C, or K color. For example, it is preferable to use a green color, which is within the range of a hue angle of approx. 100 to 240 deg.

Figure 5:
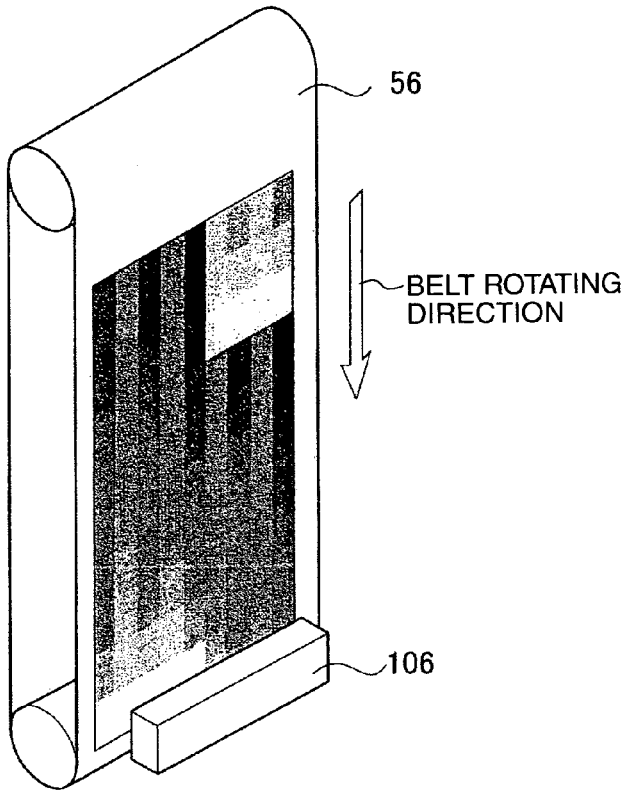
FIG. 5 is a perspective view showing an example of forming a gradation patch pattern image onto an intermediate transfer belt 56 in Step S5 and reading the gradation patch pattern image with a sensor 106 in Step S6 shown in FIG. 3.

Referring to FIG. 5, there is shown an example of forming the gradation patch pattern image onto the intermediate transfer belt 56 in Step S5 and reading the gradation patch pattern image with the sensor 106 in Step S6. As shown in FIG. 5, the sensor 106 applies light to the patches formed on the intermediate transfer belt 56 according to a rotation of the intermediate transfer belt 56, detects a reflectance of its reflected light, and outputs it to the control section 101.

Figure 6:
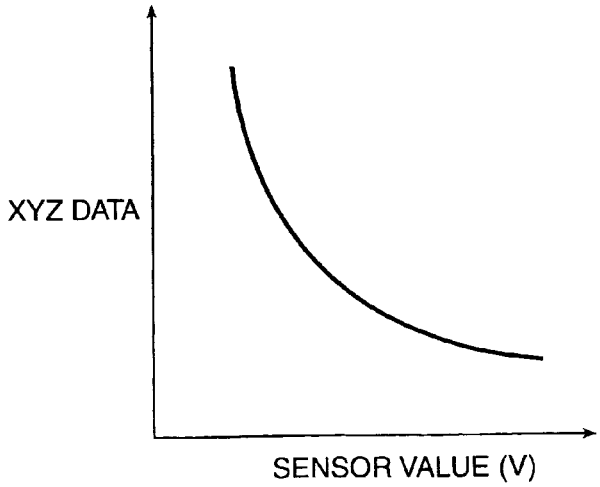
FIG. 6 is a diagram showing an example of a conversion curve for converting a sensor value to a color value (XYZ data).

Referring to FIG. 6, there is shown an example of a conversion curve for converting a sensor value to a color value (XYZ data). A curve to be set as the conversion curve depends upon each of the Y, M, C, and K colors. The conversion curve is obtained by calculating a sensor correction coefficient by carrying out the regression calculation with the color measuring result of patches of each of the Y, M, C, and K colors obtained by the scanner section 103 and the reflectance of the color patches output from the sensor 106.

In the above sensor correction coefficient calculation process, if any problem occurs, for example, if the output image of the gradation patch pattern image is incorrectly placed on the contact glass of the scanner section 103 or the gradation of the output image is abnormal due to a lack of toner or the like, an abnormal image is output unless any other process is made. Therefore, the image forming apparatus 1 is provided with a Correction Reset button in the operation display section 102 so as to return the correction coefficient to "the status before the correction." "The status before the correction" means the status before shipment, in other words, an initial value or the status immediately before the correction. The arrangement may be such that a user can select whether to return the correction coefficient to either status by means of an operation of the operation display section 102. Furthermore, the second conversion curve storing section 107*d* is provided with a storage location for the conversion curve before the correction (the conversion curve of the initial value or the conversion curve immediately before the correction, or both of the conversion curves in the case where a user can select "the status before the correction") in addition to a storage location for the current conversion curve having been corrected, so as to enable the conversion curve before the correction to be set when the Correction Reset button is depressed.

When the Correction Reset button is depressed, the control section 101 replaces the conversion curve stored in the storage location of the current conversion curve stored in the second conversion curve storing section 107*d* with the conversion curve before the correction. This enables the conversion curve to be easily returned to the status before the correction even if any trouble occurs in the correction, thereby improving the usability of the sensor correcting function.

As set forth hereinabove, according to the image forming apparatus 1, the image forming section 105 prints and outputs the gradation patch pattern image onto the transfer paper, calculates a correction coefficient of a conversion curve for converting a reflectance to a color value from a color value obtained by converting the RGB data obtained by reading an output image with the scanner section 103 to XYZ data and a reflectance obtained by reading the gradation patch pattern image formed on the intermediate transfer belt 56 with the sensor 106, and stores the conversion curve obtained from the correction coefficient into the second conversion curve storing section 107*d*.

Therefore, the sensor reading characteristics can be corrected so as to be suitable for the sensor characteristics or materials at that time, thereby improving the sensor accuracy of measurement. As a result, a gamma curve can be changed appropriately without fail by using the sensor 106, by which an output image having a stable gradation can be achieved.

In addition, even if any problem occurs in sensor correction, the conversion curve can be returned to the status before the correction easily, thereby providing a user-friendly sensor correcting function.

Contents of the description of the above embodiment is only a preferable example of the image forming apparatus 1 according to the present invention, and it is not limited to them.

For example, while the above embodiment has been described by giving an example of an electrophotographic copying machine, the present invention is not limited to this, but it is applicable to, for example, a color printer, a multifunction printer (MFP), a facsimile, a complex machine, or the like. For a printer not having a scanner, a calorimeter is used for color measuring of the gradation patch pattern image output by the printer. If a printer such as a copying machine is provided with a scanner, color measuring can be easily performed for the gradation patch pattern image by using the scanner. It is also possible, however, to perform color measuring of the output gradation patch pattern image by using a calorimeter.

In addition, in the above embodiment, it is predetermined that the image pattern to be output is the same as that formed inside the image forming section of the image printing apparatus. However, the present invention is not limited to this, but is allowed to output another image pattern different from that formed inside the image forming section. Namely, in case of reading the image pattern with the scanner, in order to facilitate the detection of patch pattern image, it is preferable that another image pattern is added, or the patch pattern is disposed at random in consideration of the ununiformity in reading density of the scanner.

Any other detailed configurations and detailed operations of the respective devices forming the image forming apparatus 1 can be appropriately changed within the spirit and scope of the present invention.

What is claimed is:

1. An image forming apparatus, comprising:

an image forming section for forming and outputting a predetermined gradation patch pattern image on a transfer paper;

a scanner section, for reading an image on a document, which reads the gradation patch pattern image on the transfer paper and performs color measuring on the gradation patch pattern image to obtain a color value of the gradation patch pattern image formed on the transfer paper;

a sensor for reading the gradation patch pattern image and outputting a sensor output value corresponding to the read gradation patch pattern image; and a control section for correcting reading characteristics of said sensor based on the sensor output value of said sensor and the color value of the gradation patch pattern image formed on the transfer paper obtained by the scanner section;

wherein the control section calculates a sensor correction coefficient by carrying out a regression calculation with the color value of the gradation patch pattern image formed on the transfer paper and the sensor output value obtained by reading the gradation patch pattern image and converts the sensor output value to a color value using the sensor correction coefficient to correct the sensor reading characteristics.

2. An image forming apparatus according to claim 1, further comprising an operation section for inputting an instruction to return the sensor correction coefficient to an initial value or to a value immediately before the correction, wherein said control section returns the sensor correction coefficient to the initial value or to the value immediately before the correction based on the instruction input from said operation section.

3. An image forming apparatus according to claim 1, wherein the gradation patch pattern image is made up of a plurality of patch patterns each having a plurality of gradation tones arranged such that corresponding gradation tones of the respective patch patterns are displaced by an interval of 1/n of a cycle length of a photosensitive drum in said image forming section, wherein n is an integer.

4. An image forming apparatus, comprising:

an image forming section for forming and outputting a predetermined gradation patch pattern image on a transfer paper;

a scanner section, for reading an image on a document, which reads the gradation patch pattern image on the transfer paper and performs color measuring on the gradation patch pattern image to obtain a color value of the gradation patch pattern image formed on the transfer paper;

a sensor for reading the gradation patch pattern image and outputting a sensor output value corresponding to the read gradation patch pattern image; and a control section for correcting reading characteristics of said sensor based on the sensor output value of said sensor and the color value of the gradation patch pattern image formed on the transfer paper obtained by the scanner section;

wherein the gradation patch pattern image comprises a plurality of gradation patch patterns, and a mark indicating an upper end of the transfer paper is added to the gradation patch pattern image formed on the transfer paper by using a color not used in the gradation patch patterns.

5. An image forming apparatus according to claim 4, wherein each of the gradation patch patterns includes a plurality of gradation tones for each of yellow, magenta, cyan, and black colors, and wherein the mark added to the gradation patch pattern image has a color of an approximately 100 to 240 degree hue angle.

6. An image forming apparatus, comprising:

an image forming section for forming and outputting a predetermined gradation patch pattern image on a transfer paper;

a scanner section, for reading an image on a document, which reads the gradation patch pattern image on the transfer paper and performs color measuring on the gradation patch pattern image to obtain a color value of the gradation patch pattern image formed on the transfer paper;

a sensor for reading the gradation patch pattern image and outputting a sensor output value corresponding to the read gradation patch pattern image; and a control section for correcting reading characteristics of said sensor based on the sensor output value of said sensor and the color value of the gradation patch pattern image formed on the transfer paper obtained by the scanner section;

wherein the gradation patch pattern image is made up of a plurality of patch patterns each having a plurality of gradation tones arranged such that corresponding gradation tones of the respective patch patterns are displaced by an interval of 1/n of a cycle length of a photosensitive drum in said image forming section, wherein n is an integer.

* * * * *